US005338235A

United States Patent [19]

Lee

[11] Patent Number: 5,338,235

[45] Date of Patent: Aug. 16, 1994

[54] SWIMMING AID

[76] Inventor: Trevor M. Lee, 10 Robert Street, Willoughby, NSW 2068, Australia

[21] Appl. No.: 30,021

[22] PCT Filed: Sep. 30, 1991

[86] PCT No.: PCT/AU91/00447

§ 371 Date: Mar. 24, 1993

§ 102(e) Date: Mar. 24, 1993

[87] PCT Pub. No.: WO92/05840

PCT Pub. Date: Apr. 16, 1992

[30] Foreign Application Priority Data

Sep. 28, 1990 [AU] Australia ..... PK2567

[51] Int. Cl.[5] ..... A63B 31/12

[52] U.S. Cl. ..... 441/59; 441/60

[58] Field of Search ..... 441/59, 60, 61, 62, 441/63, 64, 55

[56] References Cited

U.S. PATENT DOCUMENTS 1,550,542 8/1925 Haines .
1,695,125 12/1928 Rensing .
1,760,476 5/1930 Chastenay .
1,779,590 10/1930 Eillers .
1,827,308 10/1931 Dorris .
1,836,835 12/1931 Blechner .
3,107,371 10/1963 Thompson ..... 441/59
3,827,095 8/1974 Feather .
4,756,699 7/1988 Brom .

FOREIGN PATENT DOCUMENTS 2143447 3/1973 Fed. Rep. of Germany .
3336300 5/1985 Fed. Rep. of Germany .
534195 8/1922 France .
553595 5/1923 France .
777560 2/1935 France .
132942 5/1929 Switzerland .

*Primary Examiner*—Sherman Basinger
*Attorney, Agent, or Firm*—Richard C. Litman

[57] ABSTRACT

The present invention relates to an improved swimming aid wherein the aid comprises a fin (2) which is flexible and adapted in use to be fitted to a portion of the anatomy of the user, for example, the shin (4). In use the fin (2) overlays the portion of the anatomy of the user and extends outwardly towards or beyond both sides of that portion which it overlays, such that during the power stroke of the user said fin (2) extends outwardly towards or beyond both sides of the portion of the user to an extended position (18), but during the return stroke the fin member (2) adopts a substantially collapsed position (17) to reduce drag by the flexible fin.

39 Claims, 5 Drawing Sheets

SWIMMING AID

FIELD OF THE INVENTION

The present invention relates to a swimming aid and more particularly to a swimming fin and adapted to fitment to portions of the human body such as the legs, arms or torso of a swimmer.

DESCRIPTION OF THE PRIOR ART

It is known to attach swimming aids to various parts the swimmer's anatomy to increase propulsion through the water.

There are the standard feet fins, known generically as "flippers" which are attached to the feet.

Also known are attachments for the arms such as those shown in U.S. Pat. No. 2,620,495. This style of device is a rigid wing which is fixed to the forearm of the user by means of straps or the like and extends outwardly from the forearm of the user. This type of arrangement usually caused an unbalanced twisting force.

Further developments were made such as the flexible wing members as shown in U.S. Pat. No. 3,286,287, these members spreading on either side of the forearm of the user. In particular these wing members spread across a Joint of the human body whereby the movement of the Joint "rigidizes muscular rib portions of the fin"; the device being described, in use, by way of reference to the wrist, elbow and the knee.

Another direction of development is in respect of devices which are affixed to the soles of the feet of the users. These devices are almost exclusively used with the frog kick or breaststroke kick, in which the power stroke is the driving of the feet rearwardly whereby rigid wings swing out to an extended position, to provide a large surface area for thrust, while during the "glide" the fins pivot to a collapsed position, such as Australian Patent 142,282, French Patent 547,262 and Australian Patent 468,614.

A further direction of development occurred with the use of rigid hinged wings such as shown in U.S. Pat. No. 1,548,054, wherein stops are provided to hold the wings in an outstretched position during the power stroke, to allow the wings to "feather" during the return stroke. See also U.S. Pat. No. 1,824,712.

A later development along this evolutionary track is U.S. Pat. No. 4,756,699 which describes rigid fins which are attached on either side of the user's forearm and which pivot between an outwardly extending position during the power stroke, and a collapsed position during the return stroke.

A disadvantage of these hinged rigid fins is that there is no smooth transition between the return stroke and power stroke and between the power stroke and return stroke. At the beginning of the power stroke the hinged rigid fins snap back into the fully extended position.

SUMMARY OF THE INVENTION

The present invention seeks to ameliorate the disadvantages of the above described prior art by providing a swimming aid comprising a flexible fin member; and attachment means connected to or adjacent at least one end of said fin member and adapted for attachment to a portion of the anatomy of a user, whereby, in use the flexible fin member overlays the portion of the anatomy of the user and extends outwardly towards or beyond both sides of that portion, which it overlays, such that during a power stroke of the user, said fin member extends outwardly towards or beyond both sides of said portion of the user to an extended position, but during the return stroke the fin member adopts a substantially collapsed position to reduce drag by the flexible fin member.

BRIEF DESCRIPTION OF THE DRAWINGS

The invention will now be described by way of example with reference to the following drawings in which:

FIG. 2(*b*) illustrates the relevant positions of the fin member of the FIGS. 2(*a*), 3(*a*) and 4(*a*) at section line B—B during the power stroke and the return stroke.

DETAILED DESCRIPTION OF THE DRAWINGS

Figure 1:
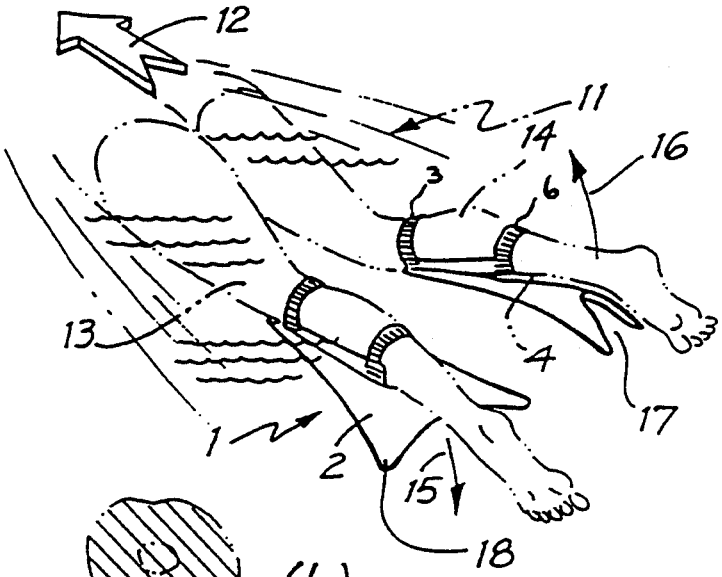
FIG. 1 is a schematic representation of one embodiment of the present invention showing the respective positions of the flexible fin men%bets during the power and the return strokes.

FIG. 1 illustrates one embodiment of the present invention fitted to the shins of a user.

The swimming aid (1) comprises a fin (2) which is fitted to a suitable fastening means (3) to the upper shin (4) of the user; Just below the knee (5). The fin (2) may have an additional attachment means (6) located for attachment below the calf, as shown in FIG. 1. The fin (2) is shaped such that the bottom of the fin (2) does not interfere with the ability of the user to walk both in water and on land, as compared with awkwardness caused by traditional swim fins which fit to the feet.

A swimming aid is attached to each shin of a user. The fin (2) extends on both sides of the shin (4) of the user to provide a more balanced propulsion force.

Figure 2:
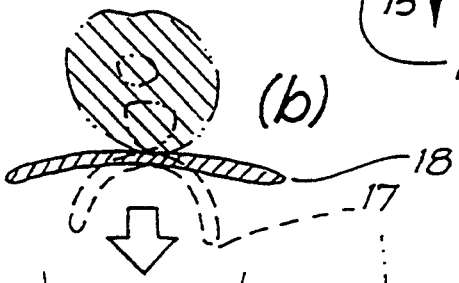
FIGS. 2(*a*), 3(*a*) and 4(*a*) represent various shapes of the fin member according to embodiments of the present invention.
Figure 2:
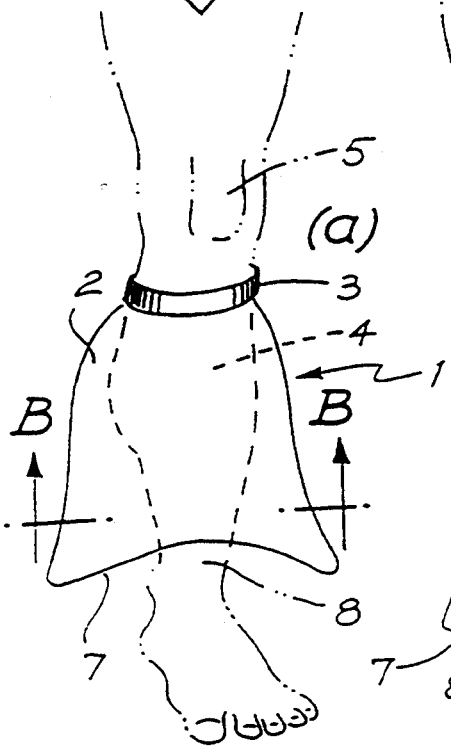
Figure 3:
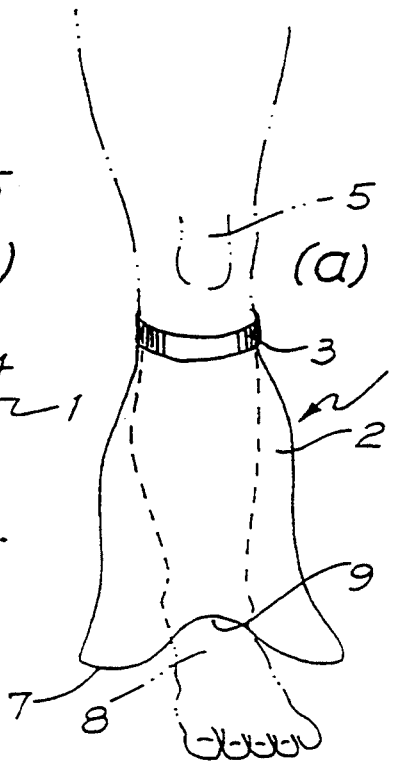
Figure 4:
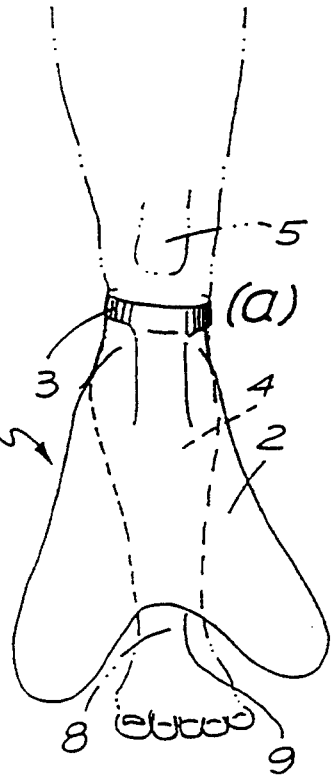

As shown in FIG. 2(*a*) the bottom edge (7) of the fin (2) stops just above the instep (8) of the user. In FIG. 3(*a*) a further embodiment is shown whereby the bottom edge (7) of the fin (2) is extended just above ground level for the user, with a suitable cutout (9) to accommodate the instep (8) of the user. The swimming aid (1) as shown in FIG. 4(*a*) has the fin (2) further modified by tapering the fin (2) in the direction of the knee (5) and moulding the fin (2) to extend around the sides of the shin (4) behind the front plane of the shin (4).

FIG. 1 shows a perspective view of a swimmer (11) executing a standard flutter kick for overarm or freestroke, swimming. In the position shown the swimmer (11) is being propelled in the direction of the arrow (12), with the left leg (13) executing the power kick/stroke in the downwards direction of arrow (15), with the right leg (14) executing the return stroke in the upwards direction of arrow (16). A swimming aid (1) is attached to each leg (13,14) as shown.

Leg (13) is shown in an intermediate position during the power stroke, with the fin (2) shown in an extended position. The leg (14) is shown in an intermediate position during the return stroke with the fin (2) flexing into a collapsed position, and flexing away from the shin (4).

The fin (2) during use, flexes between its collapsed position (17), through an at rest position to the extended position (18) reached during the power stroke.

Because of the flexibility of the fin (2) the swimming aid (1) provides a smooth delivery of propulsion during the power stroke; a smooth transition between the end of the power stroke and the start of the return stroke; a smooth but usually relatively lower deliver-of propulsion during the return stroke; and a smooth transition between the end of the return stroke and the start of the power stroke. This results in a smooth cyclical kicking stroke in which the fin (2) continually moulds itself substantially parallel to the relative direction of the water flowing adjacent to the fin (2) thereby minimising water resistance and maximising propulsion efficiency.

As shown in FIG. 2(*b*) the fin (2) during use, flexes between its collapsed position (17), through to an extended position (18) reached during the power stroke.

Preferably the fin (2) could be connected to the shin (4) such that in its at rest position, the fin (2) extends outwardly from the shin at an angle between 0 to 60 degrees to the line of the shin (4) or at an angle of between 10 to 40 degrees to the line of the shin (4).

Figure 5:
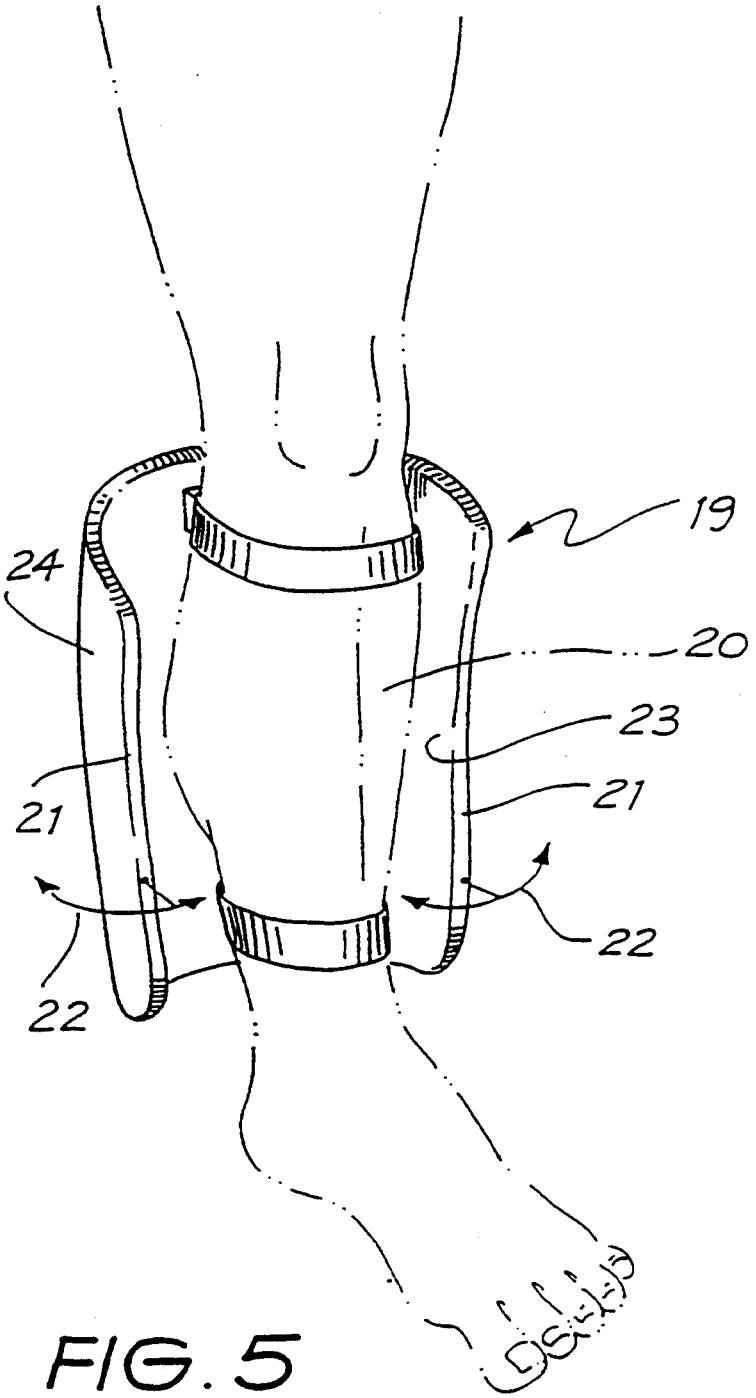
FIG. 5 illustrates another embodiment of the present invention.

Another embodiment is shown in FIG. 5 wherein the flexible swimming aid (1) is in the shape of a concave fin (19) which is attached by any suitable means, to be located at the back of the lower leg (20).

In operation this swimming aid operates in a similar manner as-the fin (2) described in FIGS. 1 to 4. In the power stroke the sides (21) of the fin (19) are forced by the water flow on the inner surface (23) to expand outwardly as shown by arrows (22). While, during the return stroke, the water flowing over the outer surface (24) returns or forces (depending on the at rest attitude of the fin (19) ) the fin (19) to a collapsed position.

Various means can be used to augment the flexing of the fin. It is accepted theory for foot fins that blade stiffness should be matched to the level of propulsion power to be delivered by the fins. The more power required, the stiffer the fins. However, to provide the correct "flex" profile, during the power and return strokes, the flexibility of the fin material in the return stroke direction must be balanced by the stiffness of the fin material in the power stroke direction.

Figure 6:
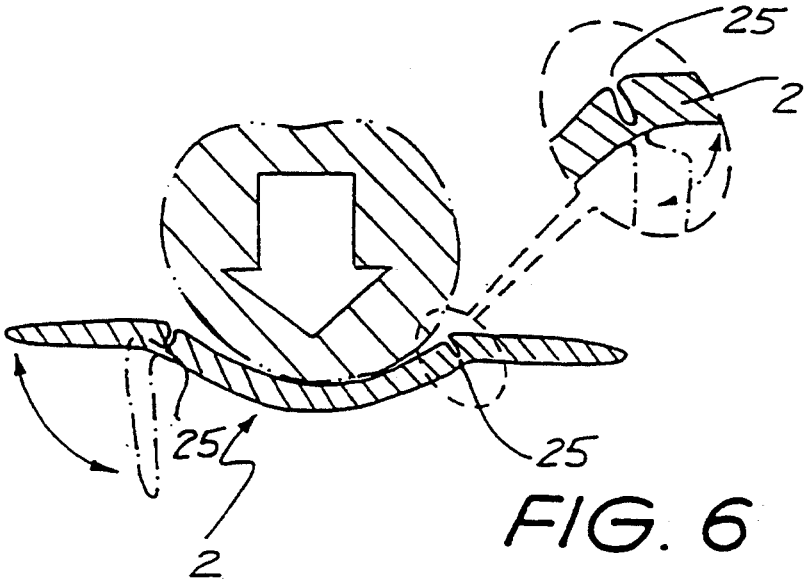
FIG. 6 illustrates a sectional schematic view of another embodiment of the present invention.

In FIG. 6 the fin (2) has a "line of weakness" (25), running along the length of the fin (2). Therefore a plastics material of relatively low flexibility could be used to provide stiffness during the power stroke, but, with its interaction with the "line of weakness" (25), provides a relatively high flexibility during the return stroke. This "line of weakness" could comprise areas on the fin (2) of different thicknesses or materials.

Figure 7:
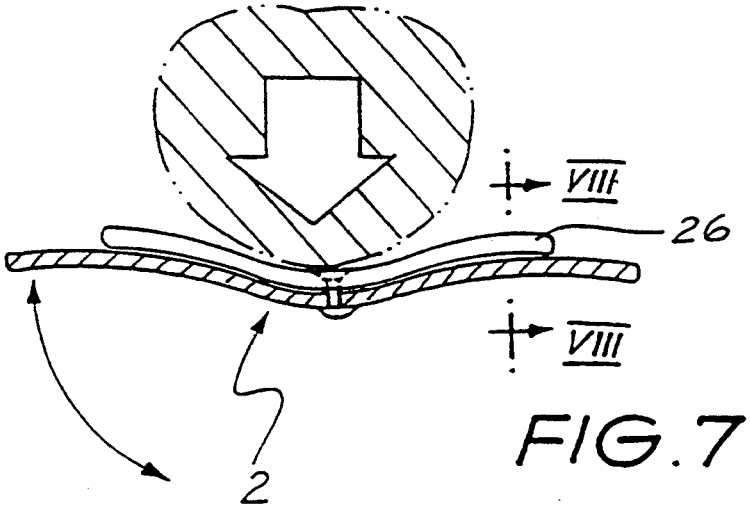
FIG. 7 illustrates a sectional schematic view of a further embodiment of the present invention.
Figure 8:
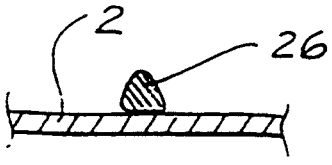
FIG. 8 illustrates a sectional view taken in FIG. V in the direction of arrows VIII—VIII of FIG. 7.

A further embodiment is shown in FIGS. 7 and 8 wherein a stifleting bar (26) extends at an appropriate position across or along the fin (2) to provide support for the fin (2) during the power stroke, but following the fin (2) to leave the bar (26) and to flex to its collapsed position during the return stroke. The bar (26) rather than being rigid could have a lower modulus of elasticity than the fin (2), and thus flex. The stifleting bar could also be moulded into the fin.

The fins of an embodiment of the present invention, could be set at an angle to the shin but also have a biasing means to bias the movement of the fin relative to the shin.

Figure 9:
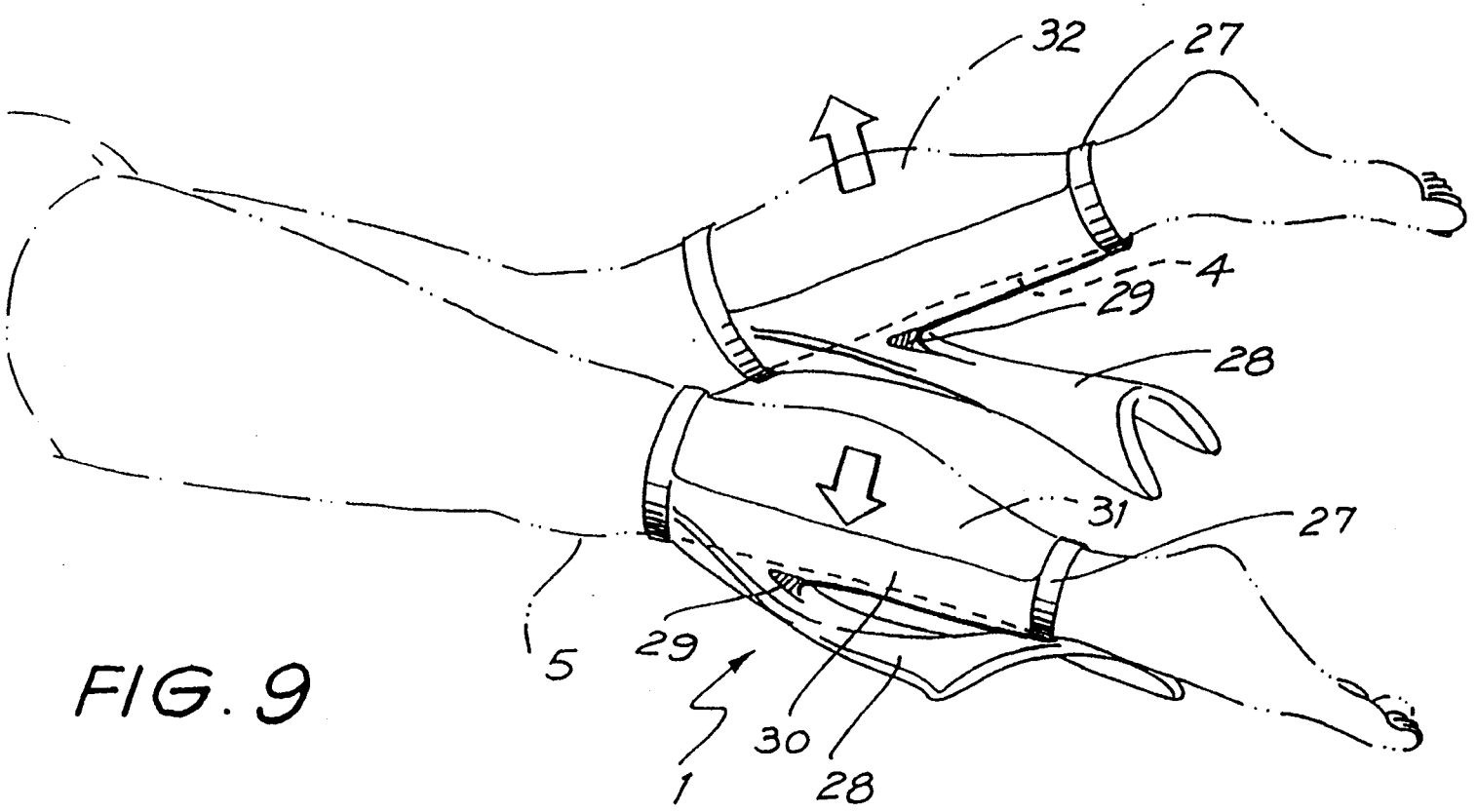
FIG. 9 illustrates a still further embodiment showing a biasing means as used in another embodiment of the present invention.

As shown in FIG. 9, the swimming aid (1) comprises a support means (27) for attachment to the lower leg. The fin or blade means (28) is connected adjacent the knee (5) to the shin piece (30) at an angle of approximately 30° to the shin at its at rest position with a biasing means (29) of any suitable form, connected between the shin piece (30) and the fin (28) to bias the fin (28) away from the shin (4) during the return stroke as is shown on leg (32), and to form a curved longitudinal profile of the fin (28) during the power stroke as shown on leg (31). The fin (28) would still flex as per the embodiments of FIGS. 1 to 4. As shown in FIG. 9 the biasing means (29) could be a shard joining member formed integrally with the fin (28) and the shin piece (30).

It is possible in a preferred embodiment to make the stiffness and angle of the fin, to the shin, adjustable, so as to accommodate different types of swimming, and different power requirements of the user or for different sizes of users. This can be achieved by means of variable tension or adjustment in a strap or other mechanism which pulls the fin towards the shin or pushes the fin away from the shin as shown by the biasing means (29) shown in FIG. 9, and can also tension or stiffen the fin.

Preferably the leading edge of the blade should blend smoothly into the shin and extend around the sides of the shin to give an effective leading edge and to minimise water resistance.

Figure 10:
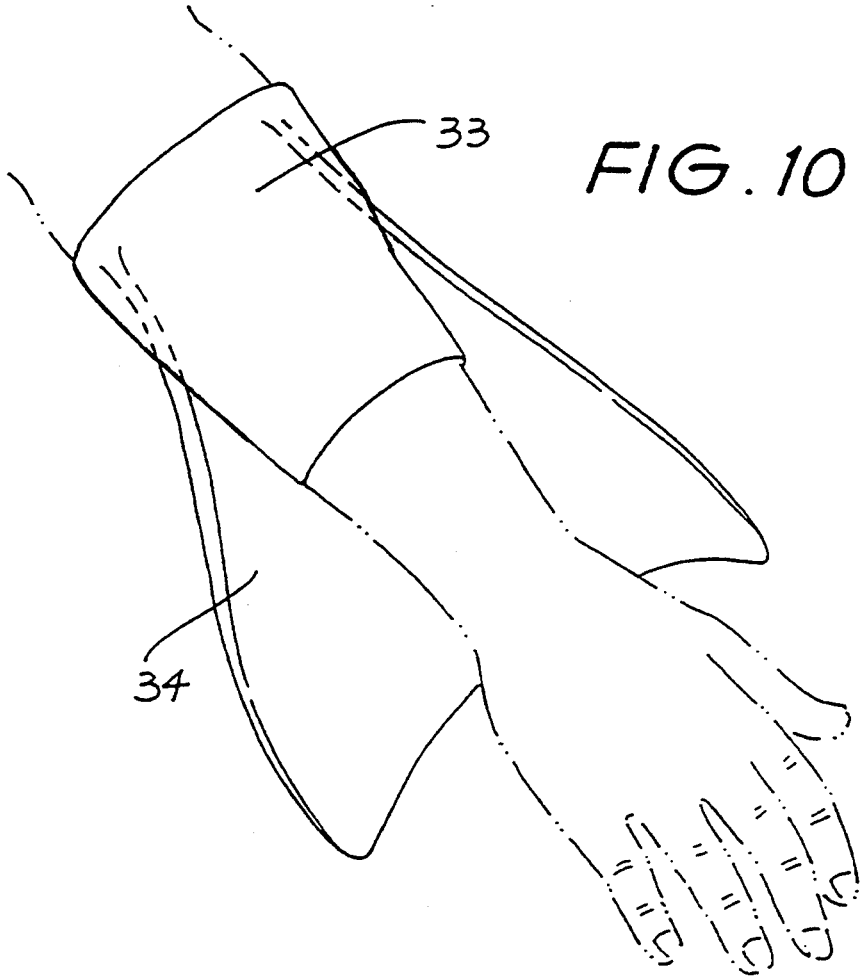
FIGS. 10 and 11 illustrate a swimming aid according to one embodiment of the present invention which is carried on the forearm of a user.
Figure 11:
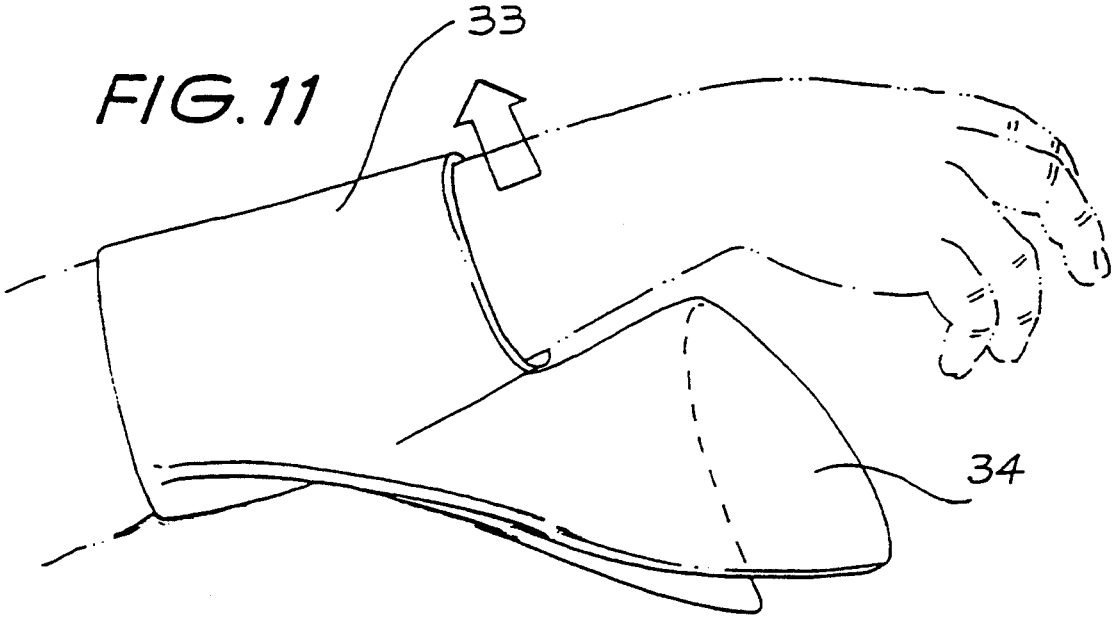

As shown in FIGS. 10 and 11, the swimming aid could be formed as a forearm attachment for swimming overarm or with the arms by the side of the user. This swimming aid (1) comprises a forearm sheath (33) with an integral wing or fin (34). The swimming aid operates in the same manner as does the swimming aid described in the previous embodiments.

However if the swimming aid is to be used for some strokes, the swimming aid could be reversed with the free end of the fin being adjacent the elbow.

The swimming aid can be affixed to any required portion of the anatomy, but in all cases the leading edge is the end of the fin fixed to that portion and therefore upstream of the free end of the fin, during all or, at least, during the most effective part of the power stroke.

The swimming aid can also be fixed to the upper leg or arm, or the torso.

The swimming aid can be fitted to various parts of the anatomy, and would be positioned (i.e. on the inner or outer portion of the leg etc.) and oriented according to the style of kick or swimming stroke to be employed; i.e. breaststroke, dolphin kick etc.

Various modifications can be made to the above embodiments without departing from the scope or the spirit of the present invention.

I claim:

1. A swimming aid comprising a flexible fin member; and an underlying attachment means connected adjacent one end of said fin member and adapted for attachment to a portion of the anatomy of a user, whereby, in use said fin member extends free from said attachment means longitudinally along substantially one face of said portion of the anatomy of the user and has edges which extend outwardly on both sides of the said fin member, away from the center line of the said face, such that during a power stroke of the user, the relevant water flow is over the surface of said fin member, which adopts an extended position, but during a return stroke said fin member flexes into a substantially collapsed position away from the said portion of the anatomy of the user to reduce drag by said fin member.

2. A swimming aid according to claim 1, wherein, in its at rest position, the fin member, at least adjacent the attachment means, extends longitudinally at an angle of between 0° and 60° to the center line of the said face of the portion of the anatomy to which it is attached.

3. A swimming aid according to claim 2 wherein, in its at rest position, the fin member, at least adjacent the attachment means, extends longitudinally to the center line of the said face of the portion of the anatomy to which it is attached, at an angle of between 10° and 40°.

4. A swimming aid according to claim 1, comprising a support means, positioned along the swimming aid to support the fin member in its extended position, but allowing the fin member to fall away from said support means during the return stroke.

5. A swimming aid according to claim 1, wherein at least one portion of the fin member has a line of weakness to assist the movement of the fin member to its substantially collapsed position.

6. A swimming aid according to claim 1, wherein a biasing means is provided to bias said fin member to one of its positions.

7. A swimming aid according to claim 1, wherein said attachment means comprises a sleeve adapted to fit over the said portion of the anatomy of the user.

8. A swimming aid according to claim 1, wherein the swimming aid is made from an elastomeric material.

9. A swimming aid according to claim 1, wherein the swimming aid is adapted for attachment to the arm of a user.

10. A swimming aid according to claim 1, wherein the angle of the fin member relative to the portion of the anatomy to which it is attached, is adjustable.

11. A swimming aid comprising a flexible fin member having a first end and a second end joined by two opposing side edges, said side edges extending from said first end to said second end; and an underlying attachment means connected adjacent said first end of said fin member and adapted for attachment to a portion of the anatomy of a user, whereby in use said fin member overlays the portion of the anatomy of the user and extends from said first end free of said attachment means, longitudinally of said portion which it overlays, to said second end, and with said opposed side edges, at least at said second end, extending outwardly on both sides of said fin member, away from the center line of said portion which it overlays, such that during a power stroke of the user, said fin member adopts an extended position, but during a return stroke the fin member flexes into a substantially collapsed position away from the said portion of the anatomy of the user to reduce drag by the flexible fin member.

12. A swimming aid according to claim 11, wherein, at its at rest position, the fin member, at least adjacent the attachment means, extends longitudinally at an angle of between 0° and 60° to the center line of the portion of the anatomy to which it is attached.

13. A swimming aid according to claim 12 wherein, in its at rest position, the fin member, at least adjacent the attachment means, extends longitudinally to the center line of the portion of the anatomy to which it is attached, at an angle of between 10° and 40°.

14. A swimming aid according to claim 11, comprising a support means, positioned along the swimming aid to support the fin member in its extended position, but allowing the fin member to fall away from said support means during the return stroke.

15. A swimming aid according to claim 11, wherein at least one portion of the fin member has a line of weakness to assist the movement of the fin member to its substantially collapsed position.

16. A swimming aid according to claim 11, wherein a biasing means is provided to bias said fin member to one of its positions.

17. A swimming aid according to claim 11, wherein said attachment means comprises a sleeve adapted to fit over the said portion of the anatomy of the user.

18. A swimming aid according to claim 11, wherein the swimming aid is made from an elastomeric material.

19. A swimming aid according to claim 11, wherein the angle of the fin member relative to the portion of the anatomy to which it is attached, is adjustable.

20. A swimming aid comprising a flexible fin member; and an underlying attachment means connected adjacent one end of said fin member and adapted for attachment to the shin of a user, with the attachment means located adjacent the knee such that the fin member extends free from said attachment means in the direction of the foot, whereby, in use said fin member extends along substantially one face of the said shin and has edges which extend outwardly beyond both sides of said face, at, at least, its free end, such that during a power stroke of the user, the relevant water flow is over the surface of said fin member which extends outwardly beyond both sides of said face to an extended position, but during a return stroke said fin member flexes into a substantially collapsed position away from said shin to reduce drag by said fin member.

21. A swimming aid according to claim 20 wherein said fin member has its free end shaped to fit around the instep of the user.

22. A swimming aid according to claim 21 wherein, at its at rest position, the fin member, at least adjacent the attachment means, extends longitudinally at an angle of between 0° and 60° to said face of the shin to which it is attached.

23. A swimming aid according to claim 22 wherein, in its at rest position, the fin member, at least adjacent the attachment means, extends longitudinally to said face of the shin to which it is attached, at an angle of between 10° and 40°.

24. A swimming aid according to claim 21, comprising a support means, positioned along the swimming aid to support the fin member in its extended position, but allowing the fin member to fall away from said support means during the return stroke.

25. A swimming aid according to claim 21, wherein at least one portion of the fin member has a line of weakness to assist the movement of the fin member to its substantially collapsed position.

26. A swimming aid according to claim 21, wherein a biasing means is provided to bias said fin member to one of its positions.

27. A swimming aid according to claim 21, wherein said attachment means comprises a sleeve adapted to fit over said shin.

28. A swimming aid according to claim 21, wherein the swimming aid is made from an elastomeric material.

29. A swimming aid according to claim 21, wherein the angle of the fin member relative to the shin is adjustable.

30. A swimming aid comprising a flexible fin member having a first end and a second end joined by two opposing side edges, said side edges extending from said first end to said second end; and an underlying attachment means connected adjacent said first end of said fin member and adapted for attachment to the shin of a user with the attachment means located adjacent said first end of said fin member and adapted for attachment to the sin of a user with the attachment means located adjacent the knee such that the fin member extends in the direction of the foot, whereby in use said fin member overlays the shin of the user and extends from said first end free of said attachment means, longitudinally of said shin, to said second end, and with said opposed side edges, at least at said second end, extending outwardly beyond both sides of the shin, which it overlays, such that during a power stroke of the user, said fin member extends outwardly beyond both sides of the shin of the user to an extended position, but during a return stroke the fin member flexes into a substantially collapsed position away from the shin to reduce drag by the flexible fin member.

31. A swimming aid according to claim 30 wherein said fin member has its free end shaped to fit around the instep of the user.

32. A swimming aid according to claim 31 wherein, in its at rest position, the fin member, at least adjacent the attachment means, extends longitudinally at an angle of between 0° and 60° to the center line of the shin to which it is attached.

33. A swimming aid according to claim 32 wherein, in its at rest position, the fin member, at least adjacent the attachment means, extends longitudinally to the center line of the shin to which it is attached, at an angle of between 10° and 40°.

34. A swimming aid according to claim 31, comprising a support means, positioned along the swimming aid to support the fin member in its extended position, but allowing the fin member to fall away from said support means during the return stroke.

35. A swimming aid according to claim 31, wherein at least one portion of the fin member has a line of weakness to assist the movement of the fin member to its substantially collapsed position.

36. A swimming aid according to claim 31, wherein a biasing means is provided to bias said fin member to one of its positions.

37. A swimming aid according to claim 31, wherein said attachment means comprises a sleeve adapted to fit over said shin.

38. A swimming aid according to claim 31, wherein the swimming aid is made from an elastomeric material.

39. A swimming aid according to claim 31, wherein the angle of the fin member relative to the shin is adjustable.

* * * * *